United States Patent [19]

Visser et al.

[11] Patent Number: 4,938,862

[45] Date of Patent: Jul. 3, 1990

[54] PROCESS FOR THE THERMAL CRACKING OF RESIDUAL HYDROCARBON OILS

[75] Inventors: Diederik Visser; Mathijs M. G. Senden, both of Amsterdam, Netherlands; Jean J. H. E. Dell Amico, Grand Couronne, France

[73] Assignee: Shell Oil Company, Houston, Tex.

[21] Appl. No.: 309,757

[22] Filed: Feb. 10, 1989

[30] Foreign Application Priority Data

Feb. 11, 1988 [GB] United Kingdom ..... 8803156

[51] Int. Cl.[5] ..... C10G 37/00

[52] U.S. Cl. ..... 208/67; 208/106; 208/950; 208/96; 208/81; 208/82

[58] Field of Search ..... 208/67, 950, 107, 106, 208/309

[56] References Cited

U.S. PATENT DOCUMENTS

| | | | |
|---|---|---|---|
| 2,539,434 | 1/1951 | Keith | 208/107 |
| 2,605,215 | 7/1952 | Coghlan | 208/128 |
| 2,917,532 | 12/1959 | Watkins | 208/107 |
| 3,928,170 | 12/1975 | Takahashi et al. | 208/128 |
| 3,941,681 | 3/1976 | Saegusa et al. | 208/107 |
| 4,599,478 | 7/1986 | Kamisaka et al. | 208/107 |
| 4,599,479 | 7/1986 | Okamoto et al. | 208/107 |
| 4,613,426 | 9/1986 | Okamoto et al. | 208/107 |
| 4,663,022 | 5/1987 | Gomi et al. | 208/67 |

FOREIGN PATENT DOCUMENTS 1518085 7/1978 United Kingdom .

OTHER PUBLICATIONS

Abstract for Japanese Patent Application No. 62-96589.

*Primary Examiner*—Helane E. Myers
*Attorney, Agent, or Firm*—Ronald R. Reper

[57] ABSTRACT

Process for thermal cracking of residual hydrocarbon oils by (1) feeding the oil and a synthesis gas to a thermal cracking zone, the gas having a temperature sufficiently high to maintain the temperature in the cracking zone by direct heat exchange at 420°-645° C.;

(2) separating the cracked products into (a) a gas, (b) at least one distillate fraction and (c) a cracked residue;

(3) separating the cracked residue into a heavy hydrocarbon oil poor in asphaltenes and a heavy hydrocarbon oil rich in asphaltenes;

(4) gasifying the oil rich in asphaltenes in the presence of oxygen and steam to produce synthesis gas; and (5) recycling synthesis gas from step 4 as feed to step 1.

8 Claims, 1 Drawing Sheet

PROCESS FOR THE THERMAL CRACKING OF RESIDUAL HYDROCARBON OILS

BACKGROUND OF THE INVENTION

The invention relates to a process for the thermal cracking of residual hydrocarbon oils.

Residual hydrocarbon oils may be obtained by distillation at atmospheric pressure of a crude mineral oil, producing straight run distillate fractions and a residual oil, also called "long residue". The long residue is usually distilled at sub-atmospheric pressure to yield one or more so called "vacuum distillates" and a residual oil, also called "short residue". Both residual oils and also other residual oils such as those obtained from tar sands and shale oils have been subject of much research aiming at conversion thereof into more valuable products.

The article in "Wissenschaft und Technik, Erdoel und Kohle-Erdgas-Petrochemie vereinigt mit Brennstoff-Chemie", 36, Oct. 1983, 457–461 concerns thermal cracking of residual hydrocarbon oils in the presence of hydrogen. A tar sand heavy oil is cracked in this manner with formation of cracked products from which a gaseous fraction containing hydrocarbons having one to four carbon atoms per molecule and a liquid residual fraction were separated. The liquid residual fraction contained 70% by weight of distillate with a final boiling point of 592° C. The experiments were carried out by preheating the tar sand heavy oil to a temperature of 375° C. and the hydrogen to a temperature of 12OO° C. and introducing the preheated material into a reaction vessel, the temperature of the hydrogen being sufficiently high to provide the heat required for the thermal cracking.

Japanese patent application publication No. 62-96589 concerns a process in which a mixture of a heavy hydrocarbon oil, hydrogen and carbonaceous fine particles is thermally cracked, the cracked products are separated into a gas, a light oil, a middle oil and a cracked residue, the cracked residue is deasphalted with formation of a deasphalted oil and a fraction relatively rich in asphaltenes, the hydrocarbon fraction relatively rich in asphaltenes is gasified in the presence of oxygen and steam with formation of synthesis gas, carbonaceous fine particles are separated from the synthesis gas and the separated particles are recycled to the thermal cracking. The presence of hydrogen in the thermal cracking zone reduces problems brought about by formation of carbonaceous products in thermal cracking and yields oil having a high stability and a low olefin content. In this known process the material to be thermally cracked is indirectly heated to the cracking temperature, that is to say via a wall through which heat is transmitted. A disadvantage thereof is the possibility of a gradual buildup of carbonaceous deposits on the inner wall by the mixture to be thermally cracked, resulting in a reduced on-stream time of the furnace in which heating takes place. This disadvantage is particularly important in those cases where high conversions of the heavy hydrocarbon oil are aimed at. Another disadvantage is that particles of metals and ash which are usually present in synthesis gas are not removed therefrom. Consequently, metals and ash will be present in increasing concentration.

It is an object of the present invention to avoid the disadvantages of indirect heating of the residual hydrocarbon oil to the cracking temperature.

Another object is to avoid concentration of particles of metals and ash in the process.

A further object is to use hydrogen in an easily available form.

SUMMARY OF THE INVENTION

Accordingly, the invention provides a process for the thermal cracking of residual hydrocarbon oils which process comprises the following steps:

(1) feeding the residual hydrocarbon oil and a synthesis gas to a thermal cracking zone, the synthesis gas having a sufficiently high temperature to maintain the temperature in the thermal cracking zone by means of direct heat exchange at a value in the range of from 420° C. to 645° C.;

(2) separating the cracked products from step 1 into (a) a gaseous fraction containing synthesis gas, (b) one or more hydrocarbon distillate fractions and (c) a cracked residue;

(3) separating said cracked residue from step 2 into one or more heavy hydrocarbon oils relatively poor in asphaltenes and one or more heavy hydrocarbon oils relatively rich in asphaltenes;

(4) gasifying one or more heavy hydrocarbon oils relatively rich in asphaltenes from step 3 in the presence of oxygen and steam with production of synthesis gas; and (5) recycling at least part of synthesis gas from step 4 as feed to the thermal cracking zone of step 1.

DESCRIPTION OF PREFERRED EMBODIMENTS

Figure 1:
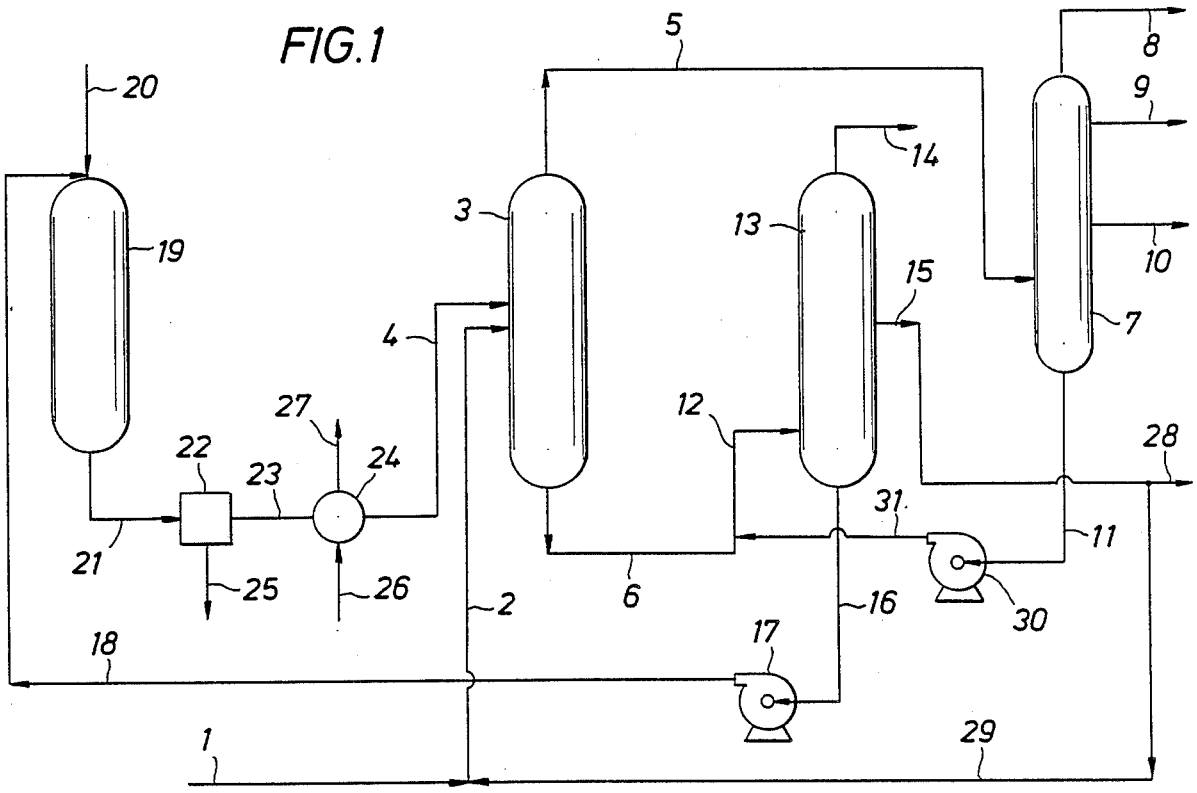
FIG. 1 represents a simplified flow scheme of the process in one embodiment of the invention.

The residual hydrocarbon oil is directly contacted in step 1 with hot synthesis gas, thus providing heat for the thermal cracking, and avoiding the disadvantages of indirect heating of the residual hydrocarbon oil to the cracking temperature. Efficient contacting is an important means to reduce formation of carbonaceous products; contacting may take place efficiently by providing a high oil to gas interface in the thermal cracking zone, by using, for example, a spray reactor in which the residual hydrocarbon oil and the hot synthesis gas are separately introduced.

The temperature in step 1 is an important process variable in thermal cracking. The desirable effect of thermal cracking, i.e. the decrease of molecular weight and viscosity of the residual hydrocarbon oil, arise from the fact that the larger molecules have a higher cracking rate than the smaller molecules. It is known from Sachanen, "Conversion of Petroleum", 1948, Chapter 3, that at lower temperatures the difference in cracking rates between larger and smaller molecules increases and, hence, the resultant desirable effect will be greater. At very low temperatures, say, below 400° C., the cracking rate decreases to uneconomically small values and a considerable amount of ethylenically unsaturated products are formed. At very high temperatures, that is to say above 645° C., much gas and carbonaceous products will be formed and less hydrocarbon distillate fractions will be produced in step 2, and less heavy hydrocarbon oils relatively poor in asphaltenes in step 3. To achieve a relatively high production of distillate fractions in step 2 and heavy hydrocarbon oils relatively poor in asphaltenes in step 3, which, moreover, have a considerably reduced content of ethylenically unsaturated products, the temperature in the thermal cracking zone is preferably in the range of from 460° C. to 550° C.

The residual hydrocarbon oil and the synthesis gas are fed to the thermal cracking zone in which a reaction mixture is formed which is allowed a certain average residence time. This average residence time is another important process variable in thermal cracking. Generally, the average residence time is set in accordance with the temperature. The thermal cracking in step 1 is preferably carried out at an average residence time in the range of from 10 sec to 10 min. At residence times below 10 sec the thermal cracking will not make sufficient progress and at a residence time of more than 10 min the amount of gas and carbonaceous products will increase and less hydrocarbon distillate fractions will be produced in step 2, and less heavy hydrocarbon oils relatively poor in asphaltenes in step 3. The average residence time is defined herein as V:F, in which "V" is the volume of the thermal cracking zone and "F" is the volume of residual hydrocarbon oil that is fed to this zone per unit of time.

The pressure in step 1 is preferably chosen in the range of from 2 to 50 bar, and in particular from 3 to 10 bar so as to provide a high oil to gas interphase in the thermal cracking zone and to enhance the production of heavy hydrocarbon oil relatively poor in asphaltenes in step 3.

Examples of residual hydrocarbon oils which may be used in step 1 of the process according to the present invention are long residues, short residues, residues obtained by distillation of hydrocarbon mixtures formed by thermal cracking of hydrocarbon oils in the absence of added hydrogen and residual oils obtained from tar sands or shale oils. If desired, the residual hydrocarbon oil may be blended with a heavy distillate fraction, for example a cycle oil obtained by catalytic cracking of a hydrocarbon oil fraction, or with a heavy hydrocarbon oil obtained by extraction from a residual hydrocarbon oil.

The cracked products from step 1 are separated in step 2 into a gaseous fraction, one or more hydrocarbon distillate fractions and a cracked residue. This may, for example, be effected by withdrawing gas from the top and the cracked residue from the bottom of the thermal cracking zone. The gas withdrawn from the top may be separated by means of distillation at atmospheric pressure into (a) a gaseous fraction containing synthesis gas, hydrocarbons having in the range of from one to four carbon atoms per molecule and hydrogen sulphide if the hydrocarbon fraction relatively rich in asphaltenes to be gasified in step 4 also contains sulphur, (b) a naphtha fraction, (c) a kerosine fraction, (d) a gas oil fraction and (e) a small amount of a residue. This small amount of residue may be mixed with the cracked residue obtained in step 2. The hydrogen sulphide may be removed from the gaseous fraction by means of any suitable conventional technique. After removal thereof the gaseous fraction may be separated by means of conventional separation techniques into synthesis gas and hydrocarbons. The synthesis gas may be reused in step 1, if desired after enrichment with hydrogen, and/or used as, for example, fuel gas or gas to drive a turbine for generation of power.

The cracked residue from step 2 contains, i.e., heavy hydrocarbon oil, asphaltenes, suspended carbonaceous particles and, if any, heavy metals.

According to a preferred embodiment of the present invention the cracked residue from step 2 is separated in step 3 by means of distillation at sub-atmospheric pressure into one or more heavy hydrocarbon oil distillates relatively poor in asphaltenes, i.e., having a lower asphaltene content lower than said cracked residue feed, and a heavy residual hydrocarbon oil relatively rich in asphaltenes, i.e., having a greater asphaltene content than said cracked residue feed. This distillation is suitably a vacuum flash and may take place in one or more columns or flash vessels containing little more than de-entrainment devices such as demisting mats and the like.

According to another preferred embodiment of the present invention the cracked residue from step 2 is contacted in step 3 with an extractant with formation of an extract phase containing the hydrocarbon oils relatively poor in asphaltenes and an extraction residue comprising the hydrocarbon oil relatively rich in asphaltenes. The extractant solvent is preferably an alkane or a mixture of alkanes, in particular propane, butane, isobutane and/or pentane. Preference is given to pentane. Such extraction processes are well known in the art. The extract phase and the extraction residue being the heavy hydrocarbon oil relatively rich in asphaltenes may be separated by means of gravity settling and the separated extract phase may be separated by means of distillation into extractant and the heavy hydrocarbon oil relatively poor in asphaltenes.

The hydrocarbon fraction relatively rich in asphaltenes also contains suspended particles of carbonaceous products and, if present at all, heavy metals, for example vanadium and nickel. This fraction is gasified in step 4 in the presence of oxygen and steam with production of synthesis gas which has as main components carbon monoxide and hydrogen, the gasification being a partial oxidation process. The hydrogen is thus easily available and need not be separated from carbon monoxide. The synthesis gas contains particles of carbonaceous products and of ash and usually of heavy metals.

The gasification in step 4 may be carried out, for example, at a weight ratio of oxygen to hydrocarbon fraction in the range of from 0.5 to 1.5 and of steam to hydrocarbon fraction in the range of from 0.2 to 1, both weight ratios depend on the molecular composition of the fuel and on the temperature at which the gasification is carried out. These weight ratios also determine the amount of carbonaceous products formed. Gasification may be carried out at a pressure in the range of, for example, 1 to 100 bar and a temperature in the range of, for example, 1000° C. to 1600° C.

Preferably, particles of metals and ash present in the synthesis gas from step 4 are removed therefrom before the gas is applied in step 5. Removal may be effected from the main synthesis gas stream but is suitably effected from a by-pass stream thereof. Suitably, removal is effected at the temperature at which the synthesis gas becomes available.

The particles of metals and ash are preferably selectively removed from the synthesis gas from step 4 before application thereof in step 5, that is to say selectively with respect to the particles of carbonaceous products therein. An advantage thereof is that the particles of carbonaceous products end up in the hydrocarbon oil relatively rich in asphaltenes separated in step 3 and are than gasified in step 4. It is a favourable feature of the present process that particles of carbonaceous products need not be disposed of as a waste product. The selective removal may be based on the differences in size and density between the particles of carbonaceous products and those of metals and ash. The particles of carbonaceous products usually have a relatively small size and relatively low density, whilst the particles of metals and ash usually have a relatively large size and relatively high density. This separation may be carried out by means of, for example, a cyclone separator. The particles of metals and ash thus separated may be further treated for recovery of the metals.

The synthesis gas should have a sufficiently high temperature to maintain the temperature in the thermal cracking zone at a value in the range of from 420° C. to 645° C. It is a favourable feature of the present invention that, with respect of this requirement, a surplus heat is usually available in the synthesis gas. Therefore, heat present in the synthesis gas from step 4 can usually be withdrawn therefrom, preferably by means of indirect heat exchange with a cooling medium, for example, water. This offers the opportunity to produce steam of relatively high pressure and to control the temperature in the thermal cracking zone. Alternatively, the synthesis gas is split into two portions, one of which is used in step 1 to maintain the temperature in the thermal cracking zone at a value in the range of from 42O° C. to 645° C. and the other is given any other suitable destination. For example, the other portion may be burned in a turbine for generation of power.

The hydrocarbon fraction relatively poor in asphaltenes separated in step 3 may be given any suitable destination. For example, as it has a relatively low density, viscosity and Conradson carbon content and does not contain carbon particles or has a very low content thereof, this fraction is very suitable as a blending component for commercial fuels. Alternatively, it may be catalytically cracked or hydrocracked for producing gasoline and kerosine fractions, or it can be recycled to the thermal cracking zone in step 1 for thermal cracking to lighter hydrocarbon distillate fractions.

The invention will now be described in more detail with reference to the accompanying drawings, wherein FIGS. 1 and 2 each depict a simplified flow scheme of the process according to the present invention in which auxiliary equipment such as, for example, heat exchangers and valves is not shown. FIG. 1 depicts the embodiment of distilling the cracked residue at sub-atmospheric pressure and FIG. 2 the embodiment of deasphalting the cracked residue.

Referring to FIG. 1, a heavy hydrocarbon oil is introduced via a line 1 and a line 2 into a thermal cracker 3. Synthesis gas is supplied via a line 4 to the thermal cracker 3 (step 1).

From the thermal cracker 3 a gaseous phase and a cracked residue are withdrawn via a line 5 and a line 6, respectively. The gaseous phase is introduced via the line 5 into a distillation column 7 in which it is separated at atmospheric pressure into a synthesis gas-containing top fraction, a full range naphtha fraction, a gas oil fraction and a bottom fraction, withdrawn from the distillation column 7 via a line 8, a line 9, a line 10 and a line 11, respectively (step 2).

From thermal cracker 3, the cracked residue is introduced via the line 6 and a line 12 into a vacuum distillation column 13 wherein it is separated at sub-atmospheric pressure into a vacuum top fraction, one or more vacuum distillates and a bottom fraction containing asphaltenes, withdrawn from the vacuum distillation column 13 via a line 14, a line 15 and a line 16, respectively (step 3). The top fraction and distillates are substantially free from or relatively poor in asphaltenes and the bottom fraction contains a higher concentration of aspaltenes than said cracked residue feed and further contains particles of carbonaceous products.

The bottom fraction containing asphaltenes is introduced via the line 16, a pump 17 and a line 18 into a gasifier 19 to which oxygen and steam are supplied via a line 20. Synthesis gas produced in the gasifier 19 is withdrawn therefrom via a line 21 (step 4).

The synthesis gas is conducted via the line 21 into a separator 22 such as a cyclone separator in which particles of metals and ash are selectively removed from the gas. Synthesis gas substantially free from particles of metals and ash but still containing particles of carbonaceous products is withdrawn from the separator 22 via a line 23 and introduced into a waste heat boiler 24 in which excess heat is withdrawn from the synthesis gas. Synthesis gas having a reduced temperature is withdrawn from the waste heat boiler 24 via the line 4 and, as stated hereinbefore, introduced into the thermal cracker 3 (step 5).

The particles of metals and ash removed from the synthesis gas in the separator 22 are withdrawn therefrom via a line 25. Water is supplied to the waste heat boiler 24 via a line 26 and high pressure steam is removed therefrom via a line 27.

The vacuum medium distillate conducted through the line 15 is, in this case, partly conducted via a line 28 to a destination outside the process and partly recirculated via a line 29 to the line 2, to increase the production of full range naphtha fraction and gas oil fraction via the lines 9 and 10, respectively. Alternatively, all of the vacuum medium distillate from the line 15 may be withdrawn via the line 28. The latter alternative is usually preferred.

From distillation column 7, the bottom fraction conducted via the line 11 is introduced via a pump 30 and a line 31 into the line 12.

Figure 2:
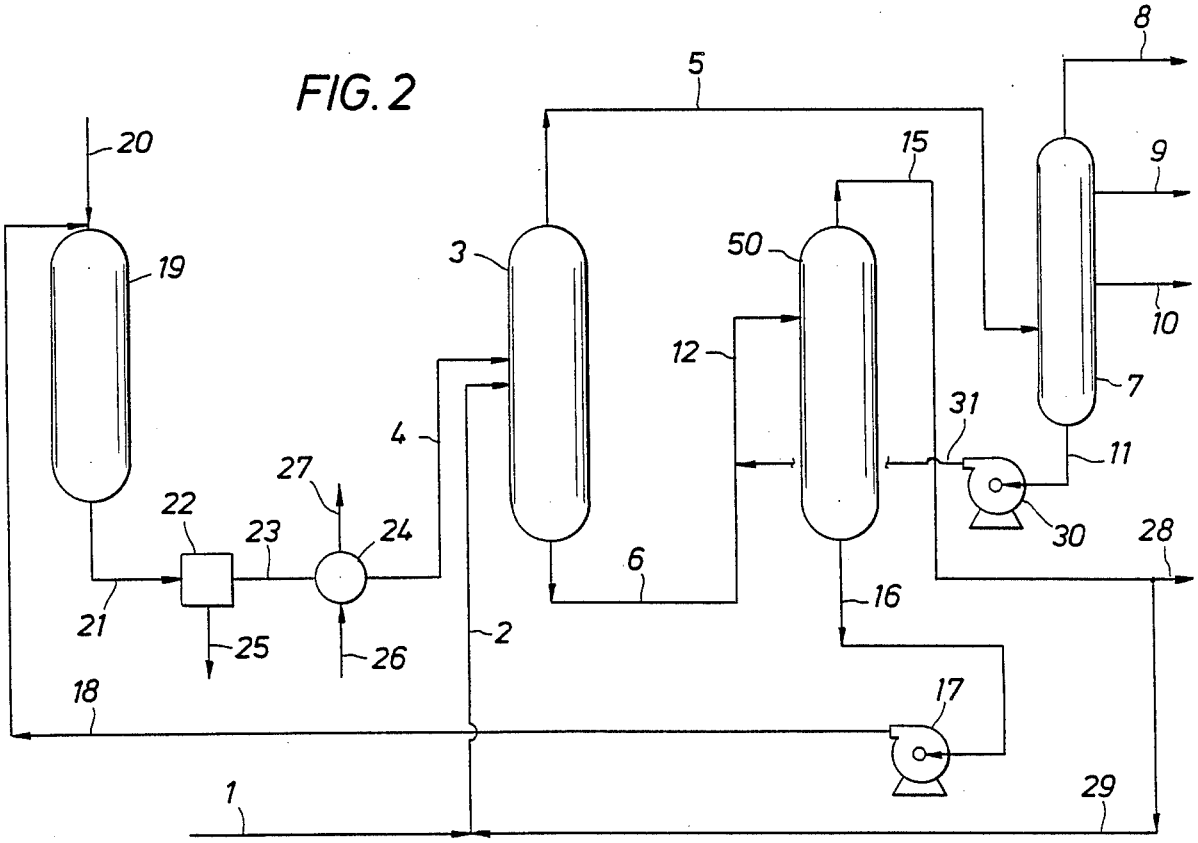
FIG. 2 schematically represents another embodiment of the process according to the present invention.

FIG. 2 represents an embodiment of the invention employing a solvent extraction step in place of the vacuum flash separation step.

In FIGS. 1 and 2 reference numerals relating to corresponding parts are the same.

Referring to FIG. 2, the cracked residue from the thermal cracker 3 is introduced via the line 6 into a solvent deasphalting unit 50 in which it is separated into a deasphalted oil substantially free from particles of carbonaceous products and a fraction containing asphaltenes and particles of carbonaceous products, withdrawn from the unit 50 via the line 15 and the line 16, respectively (step 3), the carbonaceous products originating from the gasifier 19 and the thermal cracker 3.

The deasphalted oil withdrawn via the line 15 is partly conducted via a line 28 to a destination outside the process and partly recirculated via the line 29 to the line 2 to increase the production of full range naphtha fraction and gas oil fraction via the lines 9 and 10, respectively. Alternatively, all of the deasphalted oil from the line 15 may be withdrawn via the line 28. This latter alternative is usually preferred.

The invention will now be further described in the following non-limiting illustrative embodiments.

ILLUSTRATIVE EMBODIMENT 1

This embodiment is carried out with reference to FIG. 1. The heavy hydrocarbon oil feed conducted through the line 1 is a short residue having the following properties:

| | |
|---|---|
| Density, 25° C./25° C. | 1.028 |
| Viscosity, 150° C. | 154 cS |
| Initial boiling point, °C. | 520 |
| Vanadium content, ppm | 135.8 |
| Nickel content, ppm | 43.3 |
| Sulphur content, % by weight | 5.30 |
| Conradson carbon, % by weight | 21.7 |
| $C_5$-asphaltenes, % by weight | 19.9 |

The abbreviation "ppm" means parts per million by weight. The thermal cracker 3 is a cylindrical vessel operated at a temperature of 475° C., a pressure of 6.0 bar and an average residence time of 3 min. The gasifier 19 is operated at a temperature of 1400° C., a pressure of 30 bar and a residence time of 5 sec, and the distillation column 14 at a pressure of 0.013 bar. High pressure steam is withdrawn via the line 27.

The following overall material balance is found:

| In Line | | kg/h | Out Line | | kg/h |
|---|---|---|---|---|---|
| 1 | Short residue | 125.0 | 8 | Light hydrocarbons and synthesis gas | 116.6 |
| 20 | Oxygen | 37.9 | 9 | Naphtha, $C_5$-165° C. | 13.3 |
| 20 | Steam | 28.4 | 10 | Gas oil, 165–370° C. | 12.1 |
| | | | 28 | Vacuum flashed distillate, 370–550° C. | 48.3 |
| | | | 25 | Solid particles of metals and ash | 1 |
| | | 191.3 | | | 191.3 |

The material balance around the thermal cracker 3 is as follows:

| In Line | kg/h | Out Line | kg/h |
|---|---|---|---|
| 4 | 112.5 | 5 | 142.0 |
| 2 | 125.0 | 6 | 95.5 |
| | 237.5 | | 237.5 |

The material balance around the vacuum distillation column 13 is as follows:

| In Line | kg/h | Out Line | kg/h |
|---|---|---|---|
| 12 | 95.5 | 14 | négligible |
| | | 15 | 48.25 |
| | | 16 | 47.25 |
| | 95.5 | | 95.5 |

Some properties of the vacuum flashed distilled in line 28 and of the fraction containing asphaltenes in line 16 are as follows:

| | Vacuum Flashed Distillate | Fraction Containing Asphaltenes |
|---|---|---|
| Density, 25° C./25° C. | 1.015 | 1.116 |
| Viscosity, cS | 30.2 at 100° C. | 779 at 200° C. |
| Vanadium content, ppm | 0.4 | 355 |

-continued

| | Vacuum Flashed Distillate | Fraction Containing Asphaltenes |
|---|---|---|
| Nickel content, ppm | 0.6 | 113 |
| Sulphur content, % by wt | 4.0 | 6.1 |
| Conradson carbon, % by wt | 0.8 | 56.2 |
| $C_5$-asphaltenes, % by wt | 0.02 | 63.6 |

The vacuum flashed distillate is free from particles of carbonaceous products. The composition of the fraction containing asphaltenes is excluding the particles of carbonaceous products.

The gas in line 4 has the following composition in %mol (at 20° C.), excluding particles of carbonaceous products:

| | | | | | |
|---|---|---|---|---|---|
| CO | 46.6 | $CO_2$ | 3.4 | $H_2S$ | 1.4 |
| $H_2$ | 41.5 | $H_2O$ | 6.5 | $N_2$ | 0.6 |

ILLUSTRATIVE EMBODIMENT 2

This example is carried out with reference to FIG. 2. The heavy hydrocarbon oil feed conducted through the line 1 is the same short residue as used in illustrative embodiment 1. The thermal cracker 3 is operated at a temperature of 475° C., a pressure of 6.0 bar and a cold oil residence time of 3 min. The gasifier 19 is operated at a temperature of 1400° C., a pressure of 30 bar and a residence time of 5 sec. The extraction column 50 is a rotating disc contactor operated isothermally at a temperature of 185° C. and a pressure of 40 bar with n-pentane as extractant. An extractant to feed weight ratio of 2.0 is used, applying a rotator speed of 100 revolutions per minute.

The following overall material balance is found:

| In Line | | kg/h | Out Line | | kg/h |
|---|---|---|---|---|---|
| 1 | Short residue | 125.0 | 8 | Light hydrocarbons and synthesis gas | 72.4 |
| 20 | Oxygen | 23.0 | 9 | Naphtha, $C_5$-165° C. | 13.3 |
| 20 | Steam | 17.4 | 10 | Gas oil, 165–370° C. | 12.1 |
| | | | 28 | Deasphalted oil | 66.8 |
| | | | 25 | Solid particles of metals and ash | 0.8 |
| | | 165.4 | | | 165.4 |

The material balance around the thermal cracker 3 is as follows:

| In Line | kg/h | Out Line | kg/h |
|---|---|---|---|
| 4 | 68.3 | 5 | 97.8 |
| 2 | 125.0 | 6 | 95.5 |
| | 193.3 | | 193.3 |

The material balance around the solvent deasphalting unit 50 is as follows:

| In Line | kg/g | Out Line | kg/h |
|---|---|---|---|
| 12 | 95.5 | 15 | 66.8 |
| | | 16 | 28.7 |

-continued

| In Line | kg/g | Out Line | kg/h |
|---|---|---|---|
| | 95.5 | | 95.5 |

The gas in line 4 has the following composition in %mol (at 20° C.), excluding particles of carbonaceous products:

| | | | | | |
|---|---|---|---|---|---|
| CO | 48.2 | $CO_2$ | 3.1 | $H_2S$ | 1.6 |
| $H_2$ | 40.9 | $H_2O$ | 6.0 | $N_2$ | 0.2 |

Some properties of the deasphalted oil in line 28 and of the fraction containing asphaltenes in line 16 are as follows:

| | Deasphalted Oil | Fraction Containing Asphaltenes |
|---|---|---|
| Density, 25° C./25° C. | 1.007 | 1.221 |
| Viscosity, cS | 65 at 100° C. | 75110 at 200° C. |
| Vanadium content, ppm | 26.5 | 530 |
| Nickel content, ppm | 12.9 | 159 |
| Sulphur content, % by weight | 4.2 | 7.1 |
| Conradson carbon, % by weight | 10.4 | 70.7 |
| $C_5$-asphaltenes, % by weight | 5.7 | 92.7 |

The composition of the fraction containing asphaltenes is excluding the particles of carbonaceous products. The deasphalted oil is free from particles of carbonaceous products.

What is claimed is:

1. A process for the thermal cracking of residual hydrocarbon oils which process comprises the following steps:

(1) feeding the residual hydrocarbon oil and a synthesis gas to a thermal cracking zone, the synthesis gas having a sufficiently high temperature to maintain the temperature in the thermal cracking zone by means of direct heat exchange at a value in the range of from 420° C. to 645° C. and maintaining said residual hydrocarbon oil in said thermal cracking zone for an average residence time of 10 seconds to 10 minutes to obtain cracked products, (2) separating said cracked products from step 1 into (a) a gaseous fraction containing synthesis gas, (b) at least one hydrocarbon distillate fraction, and (c) asphaltene-containing cracked residue;

(3) separating in a separation zone said cracked residue from step 2 into at least one heavy hydrocarbon oil having lower asphaltene content than said cracked residue and at least one heavy hydrocarbon oil having higher asphaltene content than said cracked residue;

(4) gasifying at least one said heavy hydrocarbon oil having higher asphaltene content than said cracked residue from step 3 in the presence of oxygen and steam with production of synthesis gas; and (5) recycling at least part of the synthesis gas from step 4 as feed to step 1.

2. A process as in claim 1 wherein in step 1 the temperature in said thermal cracking zone is maintained in the range of from 460° C. to 550° C.

3. A process as in claim 1 wherein in step 1 the pressure in said thermal cracking zone is in the range of from 3 to 10 bar.

4. A process as in claim 1 wherein in step 5 heat present in the synthesis gas from step 4 is withdrawn therefrom by means of indirect heat exchange with a cooling medium before the gas is recycled to step 1.

5. A process as in claim 1 wherein after step 4 particles of metals and ash present in the synthesis gas from step 4 are selectively removed before the gas is fed to the thermal cracking zone of step 1.

6. A process as in claim 1 wherein the cracked residue from step 2 is separated in step 3 by means of distillation at sub-atmospheric pressure into at least one heavy hydrocarbon oil distillate having lower asphaltene content than said cracked residue and a heavy residual hydrocarbon oil having higher asphaltene content than said cracked residue.

7. A process as in claim 1 wherein in step 3 the cracked residue from step 2 is contacted with an alkane extractant in a solvent extraction zone resulting in the formation of an extract phase containing hydrocarbon oil having lower asphaltene content than said cracked residue and an extraction residue comprising the hydrocarbon oil having higher relatively rich asphaltene content than said cracked residue.

8. A process as in claim 7 in which the extractant is at least one of propane, butane, isobutane and pentane.

* * * * *